US008727240B2

(12) United States Patent
Mueller et al.

(10) Patent No.: US 8,727,240 B2
(45) Date of Patent: May 20, 2014

(54) FUEL INJECTOR

(75) Inventors: Martin Mueller, Moeglingen (DE); Michael Huebel, Gerlingen (DE); Marco Vorbach, Freiberg (DE); Alexander Hantke, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 2325 days.

(21) Appl. No.: 10/571,952

(22) PCT Filed: Sep. 10, 2004

(86) PCT No.: PCT/EP2004/052123

§ 371 (c)(1),
(2), (4) Date: Sep. 9, 2008

(87) PCT Pub. No.: WO2005/031153

PCT Pub. Date: Apr. 7, 2005

(65) Prior Publication Data

US 2009/0008482 A1 Jan. 8, 2009

(30) Foreign Application Priority Data

Sep. 25, 2003 (DE) ..... 103 44 585

(51) Int. Cl.
*B05B 1/32* (2006.01)

(52) U.S. Cl.
USPC ..... 239/456; 239/102.2; 239/533.7; 239/533.12

(58) Field of Classification Search
CPC ..... B05B 1/30; B05B 1/3006; B05B 1/3033; B05B 1/3073; B05B 1/32; F02M 61/08; F02M 51/0603
USPC ..... 239/451–454, 456–460, 533.3–533.12, 239/584–585.5, 102.2
See application file for complete search history.

(56) References Cited

U.S. PATENT DOCUMENTS

| | | | | |
|---|---|---|---|---|
| 3,347,470 | A * | 10/1967 | Svoboda Edward J | 239/453 |
| 4,394,970 | A * | 7/1983 | Hofmann et al. | 239/453 |
| 4,759,335 | A | 7/1988 | Ragg et al. | |
| 5,090,625 | A | 2/1992 | Davis | |
| 5,170,766 | A | 12/1992 | Haas et al. | |
| 7,083,114 | B2 * | 8/2006 | Maeurer et al. | 239/102.2 |

FOREIGN PATENT DOCUMENTS

| | | | |
|---|---|---|---|
| JP | 2 61363 | | 3/1990 |
| JP | 5113871 | | 5/1993 |
| WO | WO03/067071 | * | 8/2003 |

OTHER PUBLICATIONS

Patent Abstracts of Japan, Bd. 0164, Nr. 94 (Oct. 13, 1992) & JP 04 179855 (Toyota Motor Corp., (Jun. 26, 1992) Abstract).

* cited by examiner

*Primary Examiner* — Christopher Kim
(74) *Attorney, Agent, or Firm* — Kenyon & Kenyon LLP

(57) ABSTRACT

A fuel injector has a valve needle that has a maximum diameter at a flow-off edge, and a valve seat acting together with the valve needle using a sealing seat, the valve seat widening, starting from the sealing seat up to a discharge edge, and the flow-off edge of the valve needle being offset backwards, in relation to the flow direction, with respect to the discharge edge of the valve seat, when the fuel injector is closed. The flow-off edge of the valve needle is offset backwards with respect to the discharge edge of the valve seat in a predetermined range of 2 micrometers to 20 micrometers, in the direction of a longitudinal valve axis.

8 Claims, 1 Drawing Sheet

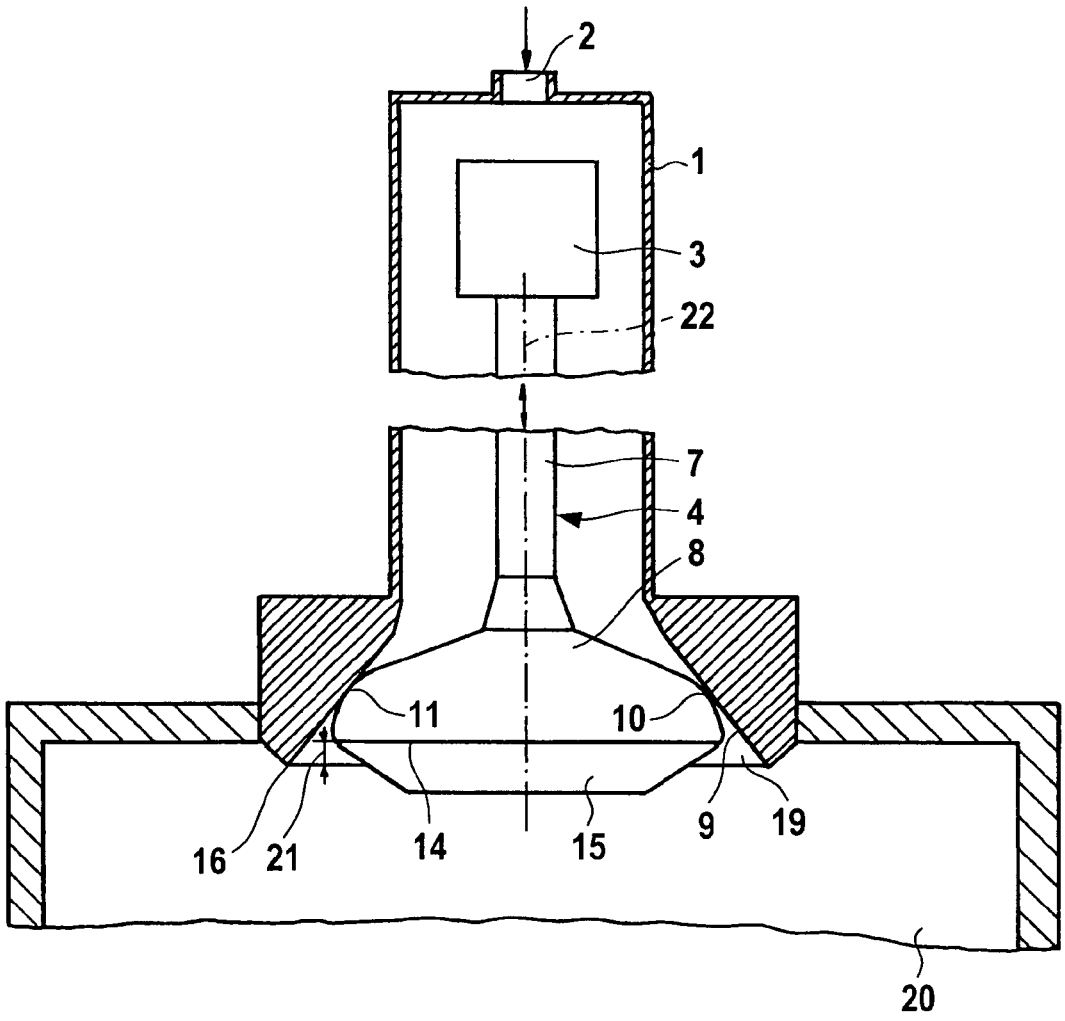
2
1
3
22
7
4
8
11
10
16
21
14
15
9
19
20

FUEL INJECTOR

FIELD OF THE INVENTION

The present invention relates to a fuel injector for direct injection of fuel.

BACKGROUND INFORMATION

A fuel injector is described in U.S. Pat. No. 4,759,335, which has a valve needle that has a maximum diameter at a flow-off edge, and which has a valve seat acting together with the valve needle using a valve seat, the valve seat widening, starting from the sealing seat, up to a discharge edge, and the flow-off edge of the valve needle being offset backwards, in relation to the flow direction, with respect to the discharge edge of the valve seat, when the fuel injector is closed. The fuel injector sprays the fuel at a predetermined jet angle into a combustion chamber of an internal combustion engine. The disadvantage of this arrangement is that an inadmissibly high jet angle spread may occur, at too low or too great a back offset of the flow-off edge.

SUMMARY

The fuel injector according to the present invention, has the advantage that the jet angle spread is reduced in a simple manner by setting back the flow-off edge of the valve needle in a predetermined range of 2 micrometers to 20 micrometers with respect to the discharge edge of the valve seat, in the direction of a longitudinal valve axis. In this setting back of the flow-off edge, which is not known in the conventional art, no depositing takes place at the flow-off edge of the valve needle.

It is of particular advantage if the flow-off edge of the valve needle is offset backwards at a predetermined range of two micrometers to 12 micrometers with respect to the discharge edge of the valve seat, since at this range particularly low jet angle spreads take place. According to one example embodiment, the setback of the flow-off edge of the valve needle with respect to the discharge edge of the valve seat amounts to ten micrometers.

It is further advantageous that the valve needle cooperates with an actuator, the actuator being, for example, a piezoactuator.

It is also very advantageous if the valve needle executes a lift in the direction of the combustion chamber, upon opening of the fuel injector, since this represents a particularly simple constructive embodiment.

BRIEF DESCRIPTION OF THE DRAWINGS

FIG. 1 shows an exemplary embodiment of the present invention in schematic form.

DETAILED DESCRIPTION

FIG. 1 shows a fuel injector according to the present invention, which fuel injector is used, for instance, to inject gasoline into a combustion chamber of an internal combustion engine, and is used, for example, in so-called direct injection.

The fuel injector has a valve housing 1 having an intake channel 2. In valve housing 1 there is situated a schematically shown actuator 3 for the axial adjustment of a valve needle 4. Actuator 3 is, for instance, a magnetic armature cooperating with an excitable coil, a hydraulic element, a piezoactuator or the like. Actuator 3 may be encapsulated from the fuel, for example.

Valve needle 4 is provided in valve housing 1 so as to be axially displaceable, and has, for instance, a needle shaft 7 facing actuator 3, and a valve-closure member 8 facing away from actuator 3. Actuator 3 transmits its motion directly or indirectly to needle shaft 7 of valve needle 4, which causes valve-closure member 8, cooperating with a valve seat 9, to open or close the fuel injector. The fuel injector has, for instance, a so-called spherical cone seat, i.e., valve seat 9 has a conical design, for example, and valve-closure member 8 has a spherical or radial section 10 cooperating with valve seat 9. When the fuel injector is closed, valve-closure member 8 rests in a sealing manner against valve seat 9 with line and surface contact over its entire circumference, which in the following text will be denoted as sealing seat 11.

Valve seat 9 may be connected as a separate part of the fuel injector within valve housing 1, or as a single part with valve housing 1.

Valve-closure member 8 has, for instance, a greater diameter than needle shaft 7. Starting from needle shaft 7, valve-closure member 8, which has spherical section 10, widens up to a flow-off edge 14 to a maximum diameter of valve-closure member 8.

Downstream from flow-off edge 14, valve-closure member 8, for instance, has a conical section 15 in which valve-closure member 8 tapers down.

Valve seat 9 widens downstream from sealing seat 11 up to a discharge edge 16.

In valve housing 1, the fuel is guided starting from inlet port 2 to valve-closure member 8 upstream of sealing seat 11. When the fuel injector is opened, valve-closure member 8 lifts off from sealing seat 11, thereby opening a connection to combustion chamber 20 of the internal combustion engine, so that fuel flows out into combustion chamber 20 via an annular discharge gap 19 formed between valve-closure member 8 and valve seat 9. Annular discharge gap 19 widens, for example, in the direction of flow, and thereby acts as a diffuser. The greater the lift of valve needle 4 in the opening direction, the larger is discharge gap 19 and the more fuel is injected into combustion chamber 20.

The fuel injector is a so-called outwardly opening valve, for instance, valve needle 4 executing a lift in the direction of combustion chamber 20.

Discharge gap 19 widens, starting from sealing seat 11, in the direction of flow. In this context, the fuel flows along valve-closure element 8 up to a flow-off edge 14 and along valve seat 9 to discharge edge 16.

Downstream from flow-off edge 14 and discharge edge 16, a free, rotation-symmetrical fuel jet is formed which is guided, for instance, to a region near a spark plug that is not shown. The jet angle of the fuel jet that is formed comes about essentially from a tangent applied to flow-off edge 14 of valve needle 4.

The fuel injector executes a lift of the order of magnitude of about 40 micrometers, for example.

So-called jet-guided fuel methods, for instance, for direct gasoline injection, require a predetermined jet angle during operation of the internal combustion engine, so that the fuel jet reaches a predetermined region, having a low spread, for instance, in the region of the spark plug. For this purpose, flow-off edge 14 and discharge edge 16 are nearly free of burs, and valve-closure member 8 and valve seat 9 are configured to have a great surface quality in the area of valve seat 11. Burs on flow-off edge 14 and discharge edge 16 are formed to be smaller than five micrometers, e.g., smaller than one micrometer.

During the operation of the internal combustion engine, the valve surfaces of the fuel injector that are in direct contact with combustion chamber 20 are wetted with fuel which, however, is combusted only incompletely at the valve surfaces during the combustion procedures in combustion chamber 20, so that deposits are able to be formed at the valve surfaces that are in direct contact with combustion chamber 20. The formation of deposits in the region of combustion chamber 20 is also designated as coking. The deposits are composed essentially of uncombusted hydrocarbons and other combustion residues.

The formation of deposits at flow-off edge 14 of valve needle 4 should be avoided, when viewed over the service life of the fuel injector, since flow-off edge 14 essentially determines the predetermined jet angle, so that changes in the predetermined jet angle would come about in response to deposits on flow-off edge 14, and, along with that, undefined combustion states which, for example, are characterized by so-called misfires. As seen over the service life of the fuel injector, the predetermined jet angle is therefore to be kept almost constant, so that only small jet angle spreads will occur.

To avoid the formation of deposits at flow-off edge 14, flow-off edge 14 of valve needle 4 is situated in such a way that, when the fuel injector is closed, flow-off edge 14 has a predetermined backwards offset 21 from discharge edge 16 of valve seat 9, as seen in the direction of flow, that is, discharge edge 16 lies within valve seat 9. Stated in reverse, when the fuel injector is closed, discharge edge 16 is set ahead with respect to flow-off edge 14, as seen in the direction of flow, by the value of backwards offset 21.

According to the present invention, backwards offset 21 is in a range between 2 micrometers and 20 micrometers, in the direction of a longitudinal valve axis 22. Backwards offset 21 may be provided in a range between 2 micrometers and 12 micrometers, since in this range especially slight jet angle spreads occur. For example, backwards offset 21 amounts to ten micrometers. In the range, according to the present invention, between 2 micrometers and 20 micrometers, setting back flow-off edge 14 with respect to discharge edge 16 with a view to a low jet angle spread is particularly effective.

The edge (14 or 16) which precedes the other edge (14 or 16) when viewed from the combustion chamber 20 is more greatly exposed to coking than the backwards offset edge (14 or 16). Since the jet angle is determined in the area of the backwards offset 21, according to the present invention, essentially by flow-off edge 14 of valve needle 4, discharge edge 16 is to be positioned offset ahead. This has the effect that deposits form essentially at discharge edge 16 instead of at flow-off edge 14. The deposits at discharge edge 16 grow with time, the growth of the deposits in the area of discharge edge 16 being limited in the radial direction towards valve-closure element 8, since deposits extending into the radial region of valve-closure element 8 are shorn off or torn off by the lift motion of valve-closure element 8 during the opening and closing of the fuel injector. During this process, deposits outside the radial region of valve-closure element 8 are also in a position to be torn off.

If backwards offset 21 lies outside the range according to the present invention, and if it is, for example, smaller than 2 micrometer or greater than 20 micrometer, an interfering change of the predetermined jet angle will occur with time. If backwards offset 21 is greater than 20 micrometer, for example, the deposits at discharge edge 16 may grow to such an extent that they change the predetermined jet angle towards smaller jet angles. If, for example, backwards offset 21 is less than 2 micrometer, the protection provided to set-back flow-off edge 14 by set-forward discharge edge 16 is too slight, so that deposits may also occur at flow-off edge 14.

What is claimed is:

1. A fuel injector for direct injection of fuel into a combustion chamber of an internal combustion engine, comprising:

a valve needle having a flow-off edge, wherein a maximum diameter of the valve needle is at the flow-off edge; and a valve seat cooperating with the valve needle, wherein the valve seat includes a sealing seat and a discharge edge, and wherein the valve seat widens starting from the sealing seat to the discharge edge;

wherein, when the fuel injector is in a closed position, the flow-off edge of the valve needle is offset backwards, in the direction of a longitudinal valve axis, relative to the discharge edge of the valve seat, in a predetermined range of 2 micrometers to 20 micrometers; and wherein, when the fuel injector is in an open position, the flow-off edge of the valve needle extends beyond the discharge edge of the valve seat in a direction of fuel flow.

2. The fuel injector as recited in claim 1, wherein, when the fuel injector is in a closed position, the flow-off edge of the valve needle is offset backwards relative to the discharge edge of the valve seat, in a predetermined range of 2 micrometers to 12 micrometers.

3. The fuel injector as recited in claim 1, wherein, when the fuel injector is in a closed position, the flow-off edge of the valve needle is offset backwards by 10 micrometers relative to the discharge edge of the valve seat.

4. The fuel injector as recited in claim 1, further comprising:

an actuator for actuating the valve needle.

5. The fuel injector as recited in claim 4, wherein the actuator is a piezo-actuator.

6. The fuel injector as recited in claim 1, wherein opening of the fuel injector is achieved by the valve needle being lifted away from the valve seat in the direction of fuel flow through the fuel injector.

7. The fuel injector as recited in claim 1, wherein the valve needle includes a tapered conical section downstream of the flow-off edge.

8. The fuel injector as recited in claim 6, wherein, when the fuel injector is in an open position, the valve needle is lifted away from the valve seat 40 micrometers.

* * * * *

UNITED STATES PATENT AND TRADEMARK OFFICE

CERTIFICATE OF CORRECTION

PATENT NO. : 8,727,240 B2
APPLICATION NO. : 10/571952
DATED : May 20, 2014
INVENTOR(S) : Mueller et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2103 days.

Signed and Sealed this
Twenty-ninth Day of September, 2015

Michelle K. Lee

Michelle K. Lee
*Director of the United States Patent and Trademark Office*